US005555831A

United States Patent [19]

Teeth et al.

[11] Patent Number: 5,555,831

[45] Date of Patent: Sep. 17, 1996

[54] FESTOONING MACHINE

[75] Inventors: Wolfgang Teeth, Kerken; Dietmar Lippert, Pliezhausen, both of Germany

[73] Assignee: Maier-Unitas GmbH, Kongen, Germany

[21] Appl. No.: 191,414

[22] Filed: Feb. 3, 1994

[30] Foreign Application Priority Data

Feb. 9, 1993 [DE] Germany ..... 43 03 607.4

[51] Int. Cl.[6] ..... D05B 19/00

[52] U.S. Cl. ..... 112/470.06; 112/453; 112/167; 112/322

[58] Field of Search ..... 112/157, 167, 112/318, 322, 306, 163, 121.12, 470.04, 470.14, 470.06, 453

[56] References Cited

U.S. PATENT DOCUMENTS

| | | | |
|---|---|---|---|
| 112,189 | 2/1871 | Smith | 112/167 X |
| 476,664 | 6/1892 | Luraschi | 112/167 |
| 1,054,713 | 3/1913 | Reichardt | 112/157 |
| 1,597,369 | 8/1926 | Mischke | 112/157 |
| 4,681,051 | 7/1987 | Kirch et al. | 112/306 |
| 5,267,169 | 11/1993 | Yokoe et al. | 112/470.04 |

FOREIGN PATENT DOCUMENTS

| | | |
|---|---|---|
| 478872 | 4/1992 | European Pat. Off. . |
| 411199 | 6/1910 | France . |

*Primary Examiner*—Paul C. Lewis
*Attorney, Agent, or Firm*—Michael J. Striker

[57] ABSTRACT

A festooning machine has at least one transport element for a forward transportation and transverse transportation of a sewing product, two vertically movable needles arranged at a distance near the transport element and parallel to a direction of the transverse movement with an adjustable distance therebetween, a needle drive for vertically moving the needles, and a independent drive unit which supports the transport element and provides movements of the transport element.

57 Claims, 4 Drawing Sheets

Fig. 1
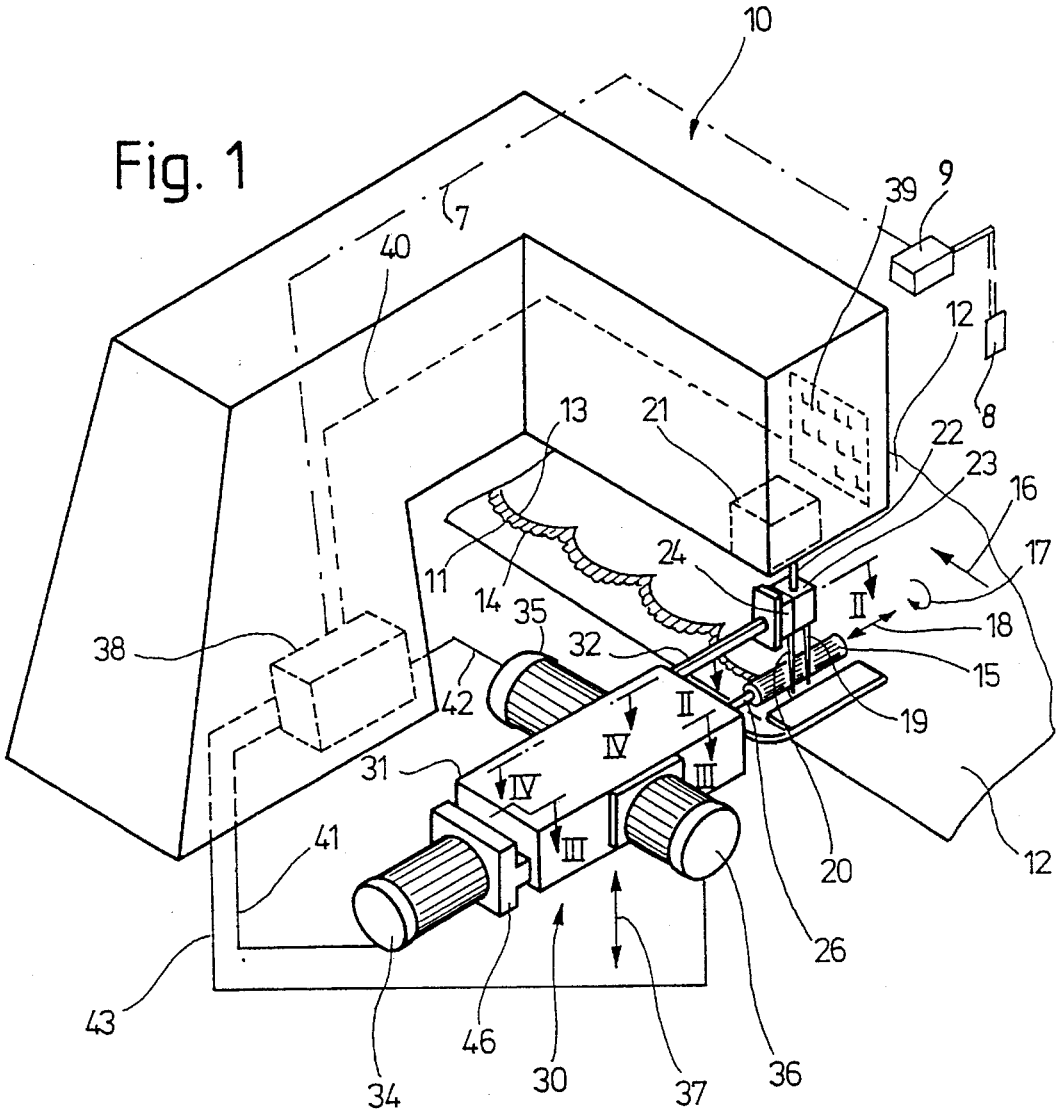
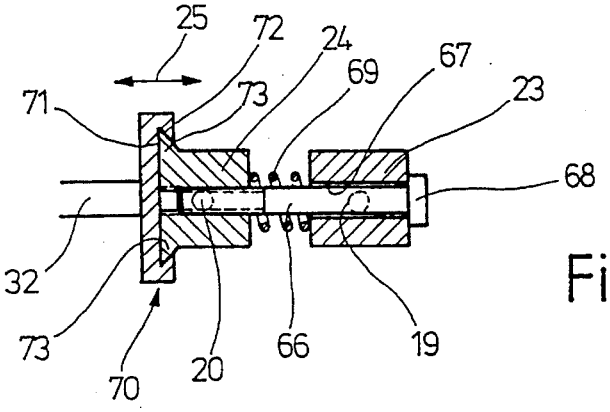
Fig. 2

FESTOONING MACHINE

BACKGROUND OF THE INVENTION

The present invention relates generally to festooning machines.

In known festooning machines the transportation of the sewing product in longitudinal direction and in transverse direction and further the control of the needle distance for producing the seams is performed from a drive which is arranged centrally in the machine, from which the drive movement is directed through complicated mechanical transmission elements to a transport element, in particular the transport roller or to at least one adjustable needle. It is also known to provide the drive of the transport element for the forward transportation of the sewing product from a central drive in the machine through an overrunning transmission and to provide the drive of the transport element in a transfer direction by means of a cam transmission with an overrunning transmission. In the known festooning machines the displacement of at least one needle over a cam transmission with a free running transmission is performed in the same manner. Such drives for the longitudinal and transverse movement of the transport element, in particular the transport roller, and further for the needle displacement are complicated, expensive and provided with relatively great play. This play results in certain limits with respect to the obtainable accuracy of the festoons to be made. Moreover, due to many mechanical components, a relatively low limit is provided for the working speed. The mechanical components also occupy an extraordinarily great area which leads to unformed machines and respective resulting losses. Another disadvantage is that the different arc shapes and combinations which are desired can be provided with great difficulties or not provided at all due to the mechanical drive components.

SUMMARY OF THE INVENTION

Accordingly, it is an object of the present invention to provide a festooning machine, which avoids the disadvantages of the prior art.

More particularly, it is an object of the present invention to provide a festooning machine which is designed so that with respect to the drive of the transport element in longitudinal direction and transverse direction, the drive is simple, cost-favorable, compact and light.

In keeping with these objects and with others which will become apparent hereinafter, one feature of the present invention resides, briefly stated, in a festooning machine which has at least one transport element driveable for a forward transportation and for transverse movement of a sewing product, and two needles which are vertically movable by a needle drive and arranged at a distance near the transport element and parallel to the transverse movement, wherein in accordance with the present invention the machine is provided with a separate, independent, and standing alone drive element which carries the transport element for the movements of the transport element.

Due to the provision of the independent drive element which carries the transport element, and in particular the transport roller, and provides the drive in the longitudinal and transverse directions, the festooning machine is substantially simplified. The number of the mechanical components for driving of the transport element is substantially reduced. This provides for an increase of the rotary speed and working speed. The reduction of the play leads to increase in the accuracy of the respective executed festoons. The independent drive unit can be relatively light, compact and place consuming with the respective advantages for the festooning machine. It is especially advantageous that no other design requirements related to other components of the festooning machine must be fulfilled and thereby they can be designed in any way, without taking into consideration the drive devices for a transport roller without any problems.

In accordance with another feature of the present invention, the drive unit engages through an adjustment member at least one needle and is formed for adjusting the relative needle distance. Thereby also the adjustment of the needle distance is performed by the independent drive unit, so that additional advantages are provided. Thereby the accuracy of the executed festoons is further increased. It is advantageous that it is possible to produce arcs without the peaks or extremely flat, long or steep arcs, which was impossible before. Also, any arc combinations and further arc shapes such as arcs with greater number of individual arcs and the production of special end arcs for corners can be made with the festooning machine of the present invention.

In accordance with another feature of the present invention, the drive unit is preferably electronically controllable for each movement of the transport element and/or the adjustment of the needle distance. The electronic control device can be automatically actuatable in dependence on stored or storable data. The control device can be provided with a keyboard for modifying sewing parameters and for programming one or several memories of the control device. The control device can be provided with a receptacle for diskettes or other data carrier, and also with one or several data processing devices. The drive unit can be vertically liftable and lowerable for insertion of the sewing product, and can be provided with a motor for each movement of the transport element and/or adjustment of the needle distance.

Individual motors provided for the longitudinal and transverse actuation of the transport element and for the needle adjustment are computer controlled. With the keyboard with or without display a free introduction and modification of all sewing parameters is possible, such as for example the seam density, arc height, arc length, seam width, etc. The execution of the individual displacement movements can be performed in accordance with a pattern. The electronic control increases the spectrum of the possible arc combinations and arc shapes, and all arcs can be modified directly on the machine. For producing a corner, the pattern or arc can be interrupted or started at any pattern point. The determination of the start and end points is performed in a freely programmable way. Also parameters are freely programmable and directly insertable on the festooning machine. The invention provides simultaneously expansion possibilities for full automation of the festooning machine.

In accordance with still further features of the present invention, the motor is formed as alternating current or direct current motor or as pressure medium actuated motor, in particular pneumatic or hydraulic motor. Each motor can be formed as a stepper motor. The motors can be controlled by one or several data processing devices.

With these features, servomotors or stepper motors can be utilized. They are small, light and space consuming. They are controllable with high accuracy and provide fast drive and adjustment movement, since the drive devices of the respective motors shave only a few mechanical parts and thereby have low masses for acceleration and retardation, and also are almost play free. Therefore, the accuracy and the working speed are increased.

The drive unit can include a carriage which is translatorily displaceable for transverse movement of the transport element, and also rotatable and axially immovable in a holder which carries the transport element. Corresponding motors and transmissions are utilized for performing the required movements. The drive devices of the individual motors are simple, space consuming, light and cost favorable and at the same time provide high precision and working speed.

In accordance with still a further feature of the present invention, the machine has a crank drive which operates on the thread laying element, and a superimposed swinging drive which also operates on the thread laying element and is driven and controlled from the crank drive. In known festooning machines the drive device of the thread laying element is extraordinarily complicated, space consuming and expensive. In the inventive machine the drive device is simplified with the above described features.

In accordance with advantageous embodiments, the machine has a switch which is actuatable for example by a knee and connected with a control device for actuating the control device so that the transport movement of the sewing product and the needle actuation is interrupted before a full end of the executed festoon, and after a turning of the sewing product by hand an actuation of a start button the transporting movement of the sewing product and the needle actuation progress until the full end of the festoon. This is performed for producing an ornamental seam extending over a corner. Thereby an operator in a simple manner actuates the respective switch for example by knee during production of a curve which extends over a corner of the sewing product. When the switch is actuated, the control device is acted upon so that the movement of the sewing product and the needle actuation is interrupted to the extent as desired by the operator and prior to storing in the memory of the control device, for example in the region of 30–50% of the full end of the executed curve. The machine stops for example at substantially half finished curve. The operator must then turn the sewing product for example by 90°, so as to continue the curve formation over corner until the full end of a curve. The continuation after turning of the sewing product is started by a starting key actuatable by the operator so that after its action the transporting movement of the sewing product and the needle actuation are continued to the full end of the curve, or in other words for the remaining 70–50% of the curve.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a schematic perspective view of a part of a festooning machine with a drive unit in accordance with the present invention;

FIG. 2 is a view showing a schematic horizontal section in the region of the needle, taken along the line II—II in FIG. 1, on an enlarged scale;

DESCRIPTION OF THE PREFERRED EMBODIMENTS

Figure 3:
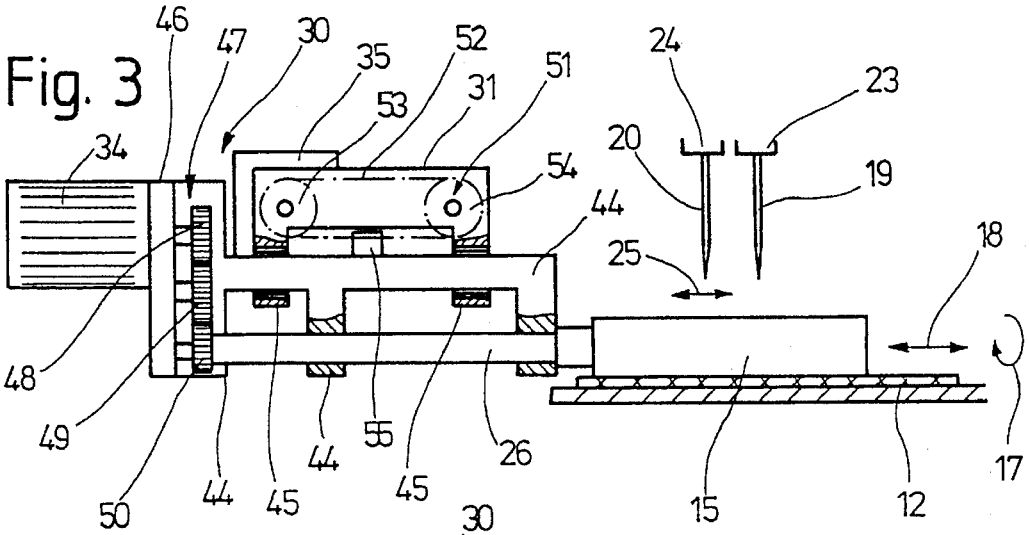
FIG. 3 is a view showing a schematic vertical section taken along the line III—III in FIG. 1 of the drive unit with drive elements for a transport element, in particular a transport roller, on an enlarged scale.

FIGS. 1–4 and FIG. 10 show a first embodiment of a festooning machine in accordance with the present invention as identified with reference numeral 10. The festooning machine of this type is used generally in the production of household textiles, such as for example tablecloths, pillows, clothes, etc. for producing overlapping seams 11 in a corresponding sewing product 12, wherein the overlapping seams 11 are frequently arcuate finish seam, ornamental seams, etc. An arc (festoon) can be composed of a base arc 13 and a pinked (serrated) image 14, with different variations. The festooning machine 10 has a transport element formed for example as a transport roller 15 which is oriented substantially horizontally and transverse to a running direction of the sewing product identified with the arrow 16. For forward transportation of the sewing product 12 the transport roller 15 is rotatable in direction of the arrow 16, as identified with an arrow 17. Further, the transport roller 15 is also driveable for a transverse movement in accordance with the arrow 18 or in other words transverse to the running direction of the arrow 16 and in the axial direction of the transport roller 15. Therefore the transport roller 15 performs the stroke required for producing of the festoon and can be transferred to the sewing product 12 for this stroke movement.

The festooning machine 10 further has two needles 19 and 20 which are preferably jointly vertically movable and driveable by a needle drive 21 shown in broken lines in FIG. 1. The needle drive 21 acts through a drive member 22, for example a rod, on a needle receptacle 23 on which one needle 19 is mounted. The second needle 20 with its associated needle receptacle 24 is arranged so that it is translatorily displaceable on the needle receptacle 23 in the direction of arrow 25. Both needle receptacles 23, 24 with the needles 19, 20 are jointly driven by the needle drive 21 in the vertical direction. Both needles 19, 20 are located laterally near the transport roller 15 and located substantially parallel to the transverse movement direction of the arrow 18 at a distance from one another. The distance between the needles 19 and 20 is adjustable, for example by displacing the rear needle 20 relative to the front needle 19 in the direction of arrow 25.

The festooning machine 10 has a independent drive unit 30 with a housing 31. The independent drive unit 30 carries the transport roller 15 and serves for driving the transport roller 15 in both movements, in other words to provide a rotary drive in the direction of arrow 17 and a transverse movement or stroke in the direction of arrow 18. Moreover, the independent drive unit 30 also serves for adjusting the relative needle distance between the needles 19 and 20, in particular for translatory displacement of the needle 20 in the direction of arrow 25. For this purpose an adjusting member 32 engages the needle 20, in particular the associated needle receptacle 24. The adjusting member 32 is formed for example as a non-rotatable slider 33 which is held translatorily displaceably in the drive unit 30. The drive movement produced by the drive unit 30 for the transport roller 15 is transferred by the latter to a shaft 26 which is supported in the drive unit 30.

The drive unit 30 has a motor 34 for each movement of the transport roller 14 for rotary drive in the direction of arrow 17 and a motor 35 for driving in transverse movement direction of the arrow 18. Further, the drive unit has a motor 36 for adjusting the needle distance in the direction of arrow 25, in particular for displacing the needle 20. The respective motors 34, 35, 36 are formed as alternating current motors or direct current motors or as pressure medium-operated motors, in particular pneumatic or hydraulic motors. Each motor 34, 35, 36 is formed for example, as a servomotor or instead advantageously as a stepper motor.

For laying the sewing product 12, the whole drive unit 30 is liftable and lowerable in a vertical direction according to the arrow 37 in FIG. 1.

The drive unit 30 for each movement of the transport element, in particular the transport roller 15, in the direction of arrows 17 and 18 and/or for the adjustment of the needle distance between the needles 19 and 20 in the direction of arrow 25, is preferably electronically controllable. For this purpose, the festooning machine 10 has at least one control device 38 for the drive unit 30 shown in a broken line, with an associated keyboard 39 with or without a display as also shown in broken line in FIG. 1. It is connected with the control device 38 by a control conductor 40. The control device 38 is connected through schematically shown control conductors 41, 42, 43 with respective motors 34, 35, 36 to be controlled. These control conductors are illustrated as freely extending conductors for better visibility.

The drive unit 30 is controllable by the electronic control device 38 in dependence on stored or storable data. By means of the keyboard 39 the consumer can perform free introduction and modification of all sewing parameters for example the seam density, arc height, arc length, seam width, the curve design with adjustment or positioning of the curves, the end arcs for corners, etc. For this purpose, the keyboard 39 provides a calling-in from one or several memories of the control device 38 of freely programmable or storable data or programs. The control device 38 can have a receptacle for diskettes or other data carriers. The control device 38 can be provided with one or several data processing devices. The motors 34, 35, 36 are thereby controlled by means of one or several data processing devices.

In the festooning machine 10 designed as specified hereinabove, all sewing parameters are executed in a computerized manner. The user's execution is performed through the keyboard 39, in some cases with a display, for example in LCD display. The machine software utilized for operating the festooning machine 10 includes on the one hand a control software for controlling the festooning machine 10 and on the other hand an input software, whereby on the festooning machine 10 arcs or contours or the like can be introduced by data pairs through the keyboard 39. In addition, when a special software is utilized it is possible to produce data for the operation of the festooning machine 10 also on a personal computer. The above described festooning machine makes possible to program all above mentioned sewing parameters on the machine in a free manner. It has the advantage of providing possibilities of a free introduction and modification of all above mentioned sewing parameters. A further advantage is that in the machine also arcs without repeats can be produceable as well as flat and long and also steep arcs or design shapes, which have not been possible until now. The machine makes possible production of any arc combinations and further arc shapes for example arcs with greater number of individual arcs, for producing special end arcs for corners. The adjustment or positioning of the curves is possible by a key pressing on the machine. The machine has a further advantage of increased, higher accuracy with respect to the executed arcs. This advantage results from the advantage of an approximately play free drive unit 30 due to the elimination of complicated mechanical components. For the same reason the festooning machine 10 makes possible higher rotary speeds and thereby greater working speeds. Due to the drive unit 30, and in particular the electronically controlled motor 34, 35, 36, a precise and pattern-accurate execution of the individual movements in direction of the arrows 17, 18, 25 is obtained, whereby the accuracy is further increased.

The details of the drive unit 30 which provide the drive movements for the transport roller 15 in direction of the arrows 17 and 18 are shown in the schematic drawing of FIG. 3.

The drive unit 30 has a carriage 44 which is held and guided translatorily displaceably in the drive unit 30 in direction of the arrow 18 for transverse movement of the transport roller 15. For this purpose the carriage 44 is displaceably held and guided inside a frame 45 which is a component of the drive unit 30. A shaft 26 is rotatable in the carriage 44 as a holder for the transport roller 15 and at the same time is axially non-displaceable. The shaft 26 extends with its right end in FIG. 3 to the transport roller 15. The first motor 34 which operates for rotating the transport roller 15 is located for example outside of the drive unit 30. The motor 34 is arranged on a housing part 46 which is a part of the carriage 44 and is displaced with it, so that with the carriage 44 the housing part 46, the first motor 34 and the shaft 26 with the transport roller 15 are displaced as a unit in the direction of arrow 18. The first motor 34 acts through a transmission 47 inside the housing part 46 on the shaft 26. The transmission 47 in a simple manner is composed of a toothed gear transmission, and particularly spur gear transmission. It has a pinion 48 driven from the motor 34 and acting through an intermediate toothed gear 49 on a toothed gear 50 which is non-rotatably held on the shaft 26.

The second motor 35 which is provided for the stroke drive in direction of the arrow 18 is also mounted on the drive unit 30. It acts with a drive device 51 on the carriage 44 onto the transport roller 15 which is directly displaced in the stroke direction 18. The drive device 51 has an endless belt 52, in particular a toothed belt, which is guided through a driven belt pulley 53 and a spaced second belt pulley 54 and supported in the housing 31 of the drive unit 30. The belt 52 engages a driver 55 which is mounted on the carriage 44, so that a reciprocating drive movement of the belt 52 produced by the motor 35 is transmitted to the carriage 44 and from it to the transport roller 15. This drive device 51 is a simple, cost-favorably and operation-reliable device. It is composed only of a few parts. The belt 52 has in addition the advantage that tolerances and the like can be compensated. In general, this design of the drive device 51 together with the associated second motor 35 is especially simple operation secure and cost favorable.

Figure 4:
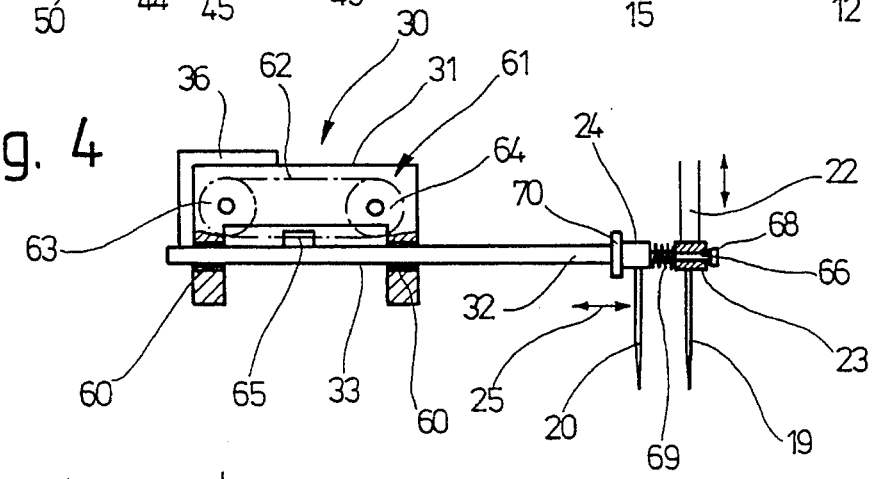
FIG. 4 is a view showing a schematic vertical section along the line IV—IV in FIG. 1 of the drive unit with both needles and elements for adjusting a needle distance.

FIG. 4 shows an adjustment drive for needle adjustment in the direction of arrow 25. The third motor 36 of the drive unit 30 provided for this purpose is, similarly to the second motor 25, a solid component of the drive unit 30 and arranged on its housing 31 from outside. It is to be understood that the motor 30 is spatially best placed in the location where most favorable space conditions are provided for it. The motor 36 executes the needle adjustment with a drive device 61 which is designed similarly to the drive device 51 and is accommodated in the housing 31 of the drive unit 30. The drive device 31 serves for driving the slider 33 which is held and guided in the drive unit 30 by means of receptacles 60 in a translatorily displaceable but non-rotatable manner. The drive device 61 has an endless belt 62, in particular a toothed belt, which is guided over a belt pulley 63 driven by the motor 36 and spaced second belt pulley 64 and engages a driver 65 fixedly arranged on the slider 33.

As can be seen in particular from FIGS. 2 and 4, the needle receptacle 24 of the rear displaceable needle 20 is displaceably held by a guiding pin 66 which engages in a guiding opening 67 of the other needle receptacle 23. The guiding pin 66 is provided at its end with an end abutment 68 against which the other needle receptacle abuts. The guiding pin 66 is mounted on the needle receptacle 24 of the displaceable, rear needle 20 and is displaceable inside the guiding opening 67 of the other needle receptacle 23 relative to it, so that the end abutment 68 abuts against the needle receptacle 23 at the left in FIG. 2 as abutment limit for the displacement direction. The needle receptacle 24 of the displaceable needle 20 is prestressed by a spring 69 against the other needle receptacle 23 in direction of the guiding pin 66. The spring 69 can be arranged in any suitable location, and it actuates the needle receptacle 24 to the left in FIG. 2 with a spring force so that it abuts with the end abutment 68 against the other needle receptacle 23. The spring 69 is composed in the shown embodiment advantageously from a helical spring which is arranged on the guiding pin 26 and in the intermediate space between both needle receptacles 23 and 24.

In order to insure the vertical drive movement produced by the needle drive 21, the adjusting member 32, in particular the slider 33, engages the needle receptacle 24 and is vertically displaceable relative to it. This is performed through a vertical displacement connection 70 between the adjusting members 32 and the needle receptacle 24. The displacement connection 70 is composed for example of a dove-tail guide 71 with vertical guiding surfaces 72 on the adjusting member 32, in which the needle receptacle 4 with a guiding strip 73 having respective guiding surfaces is held displaceably and axially non-releasably.

Figure 10:
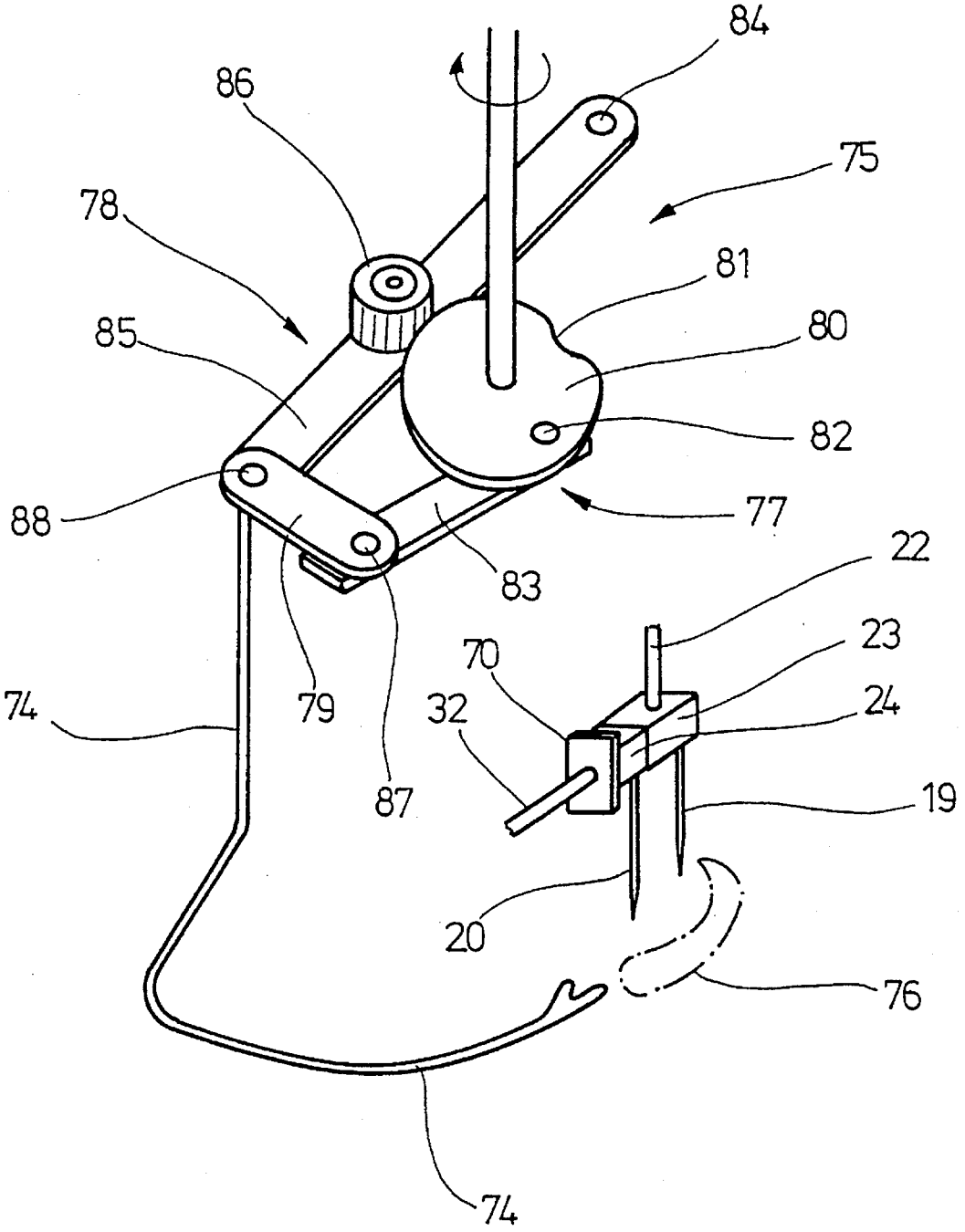
FIG. 10 is a schematic perspective view of a drive device of a thread laying element of the festooning machine of the present invention.

The festooning machine 10 further has a thread laying element 74 shown in FIG. 10. It is associated with the needles 19 and 20 and is driveable through a drive device 75 so that its end runs over a curve 76 identified with dash-dot line in FIG. 10. In this embodiment the curve 76 is a flat curve.

The drive device 75 has a crank drive 77 acting on the thread laying element 74, and a superposed swinging drive 78 which also acts on the thread laying element 74 and is driven and controlled from the crank drive 77. The crank drive 77 and the swinging drive 78 are jointly guided on a connecting lever 79 on which the thread laying element 74 is mounted, so that it extends substantially perpendicularly to the plane of the connecting lever 79 and downwardly from it.

The crank drive 77 has a rotatably driven cam disc 80 with a circumferential control surface 81 formed by an outer circumferential surface, and a displacement member 83 which is articulately coupled with the cam disc 80 at 82 and formed as a lever. The swinging drive 78 has a swinging lever 85 which is turnable at the side of the machine at 84 and carries a cam 86 formed in particular as a rotatable roller and abutting from outside against the control surface 81 so that during the rotary movement of the cam disc 80 it is controlled by the control surface 81. The connecting lever 79 is articulately connected with its one end on the displacement member 83 at 87 and with its another end with the swinging lever 85 at 88. The crank drive 77 and the swinging drive 78, in particular the cam disc 80, the displacement member 83, the swinging lever 85 and the connecting lever 79, are arranged substantially within a joint plane. This provides a favorable place utilization and leads to the situation that the movement of the thread laying member 74 produced by the drive device 75 is performed over a flat curve 76.

Figure 5:
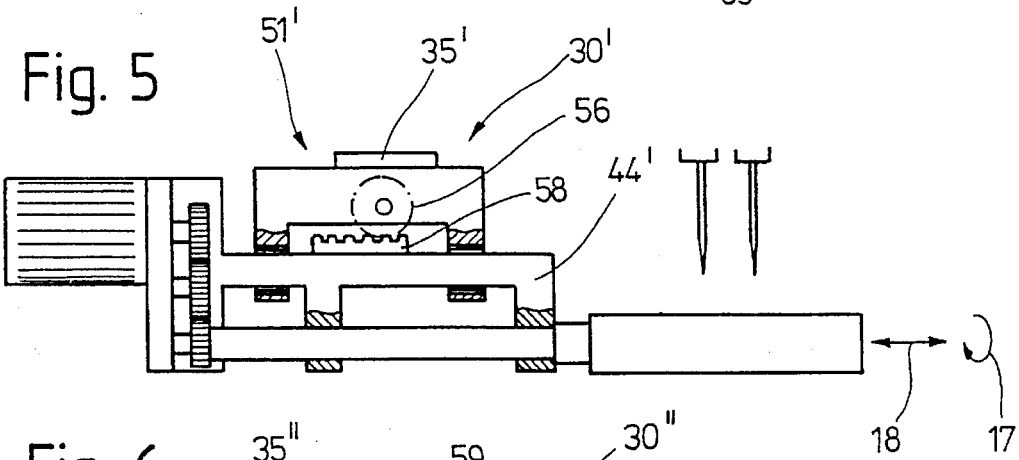
FIGS. 5, 6 and 7 are respectively a schematic section with a partial side view substantially corresponding to the view of FIG. 3, for a second, third and fourth embodiment of the drive for the transport element.
Figure 6:
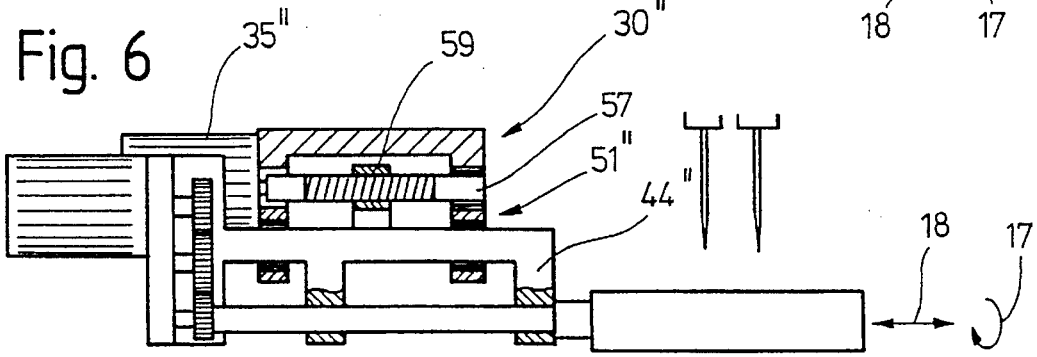

In the second and third embodiments shown in FIGS. 5 and 6, the drive device 51 with the motor 35 is modified relative to the embodiment of FIG. 3 in that the second motor 35' or 35" drives a pinion 56 in FIG. 5 or a spindle 57 in FIG. 6 which engage a toothed gear 58 or nut 59, threaded sleeve and the like mounted on the carriage 44' or 44" so as to provide the stroke drive of the transport element, and in particular the transport roller in direction of arrow 18. The remaining elements correspond to the drive unit 30 of the first embodiment, in particular shown in FIG. 3.

Figure 7:
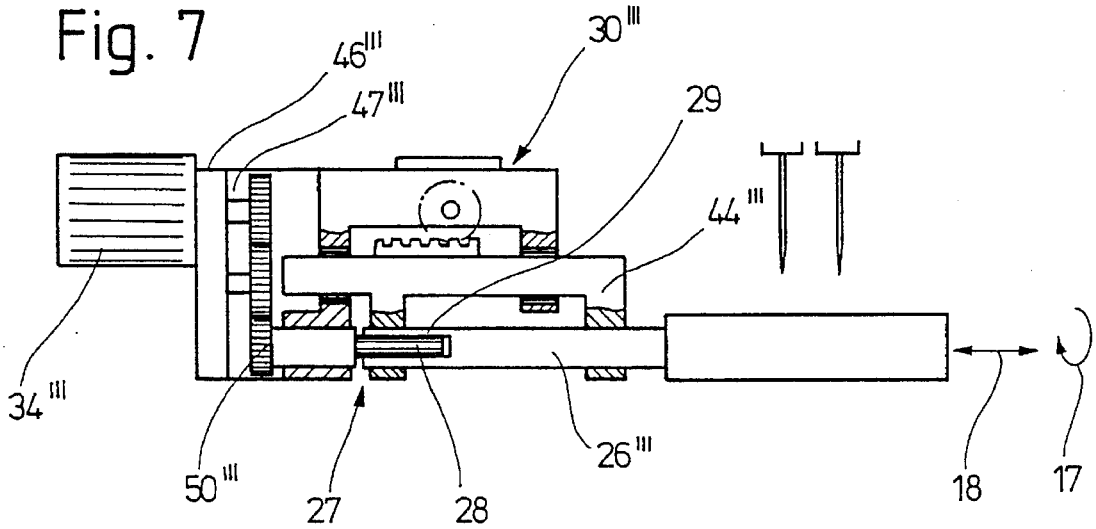

In the fourth embodiment shown in FIG. 7 the translation drive for the carriage 44''' corresponds to the drive of FIG. 5. However, in contrast to the embodiments of FIGS. 1–6, in the drive unit 30''' in FIG. 7 the first motor 34''' is not a part of the translatorily movable carriage 44''', but instead is mounted on the drive unit 30''' as the housing part 46'''. The transmission 47''' corresponds to the first embodiment, in particular FIG. 3. Since however the carriage 44''' together with the shaft 26''' is translatorily displaceable relative all other components of the drive unit 30''', the rotation of the motor 34''' is transmitted through the transmission 47''' and from it through an axial displacement connection 27 to the shaft 26'''. The displacement connection 27 has for example a wedge shaft 28 driven by the toothed wheel 50''', which engages in a relatively displaceable hollow wedge shaft 29 on the shaft 26'''. In this manner, a rotary movement in the direction of arrow 17 and a stroke movement in direction of the arrow 18 are executed with the first motor 34''' fixedly mounted on the drive unit 30'''.

Figure 8:
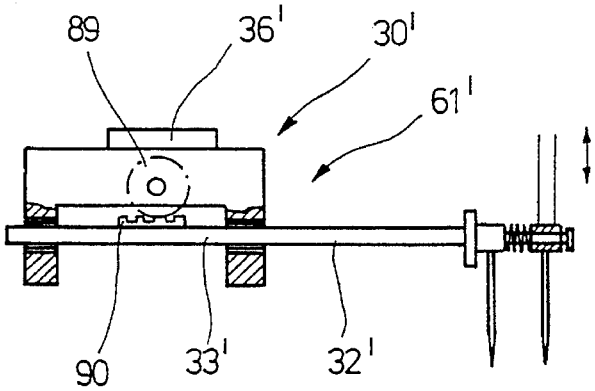
FIGS. 8 and 9 are respectively a schematic, partially sectioned side view substantially corresponding to the view of FIG. 4 for a fifth and sixth embodiment of the drive for needle displaced adjustment.
Figure 9:
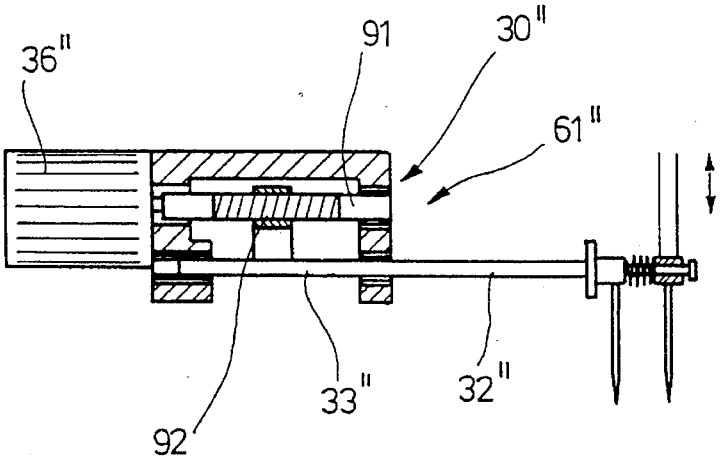

In the fifth and sixth embodiments shown in FIGS. 8 and 9, variants of the first embodiment of FIG. 4 and its drive device 61 for the needle adjustment by means of the third motor 36' or 36" are shown. In the sixth embodiment of FIG. 8 the motor 36' drives as the drive device 61 a pinion 89 which engages with a toothed rod 90 on the adjustment member 32' in particular the slider 33'. In the sixth embodiment of FIG. 9 the third motor 36"drives a spindle 91 which cooperates with a nut 92, a threaded sleeve or the like on the adjustment member 32' in particular the slider 33'.

FIG. 1 schematically shows a switch 9 which is located for example under a not shown table plate on the festooning machine 10. The switch 9 can have an associated actuating member 8 which can be actuated by an operator, for example with its knee, during the operation of the festooning machine 10 when needed, and therefore the switch 9 is actuated. The switch 9 is connected through a control conductor 10 with the control device 38.

When it is necessary to form in a corner region of the sewing product 12 such a base arc 13 which has a part (for example 30%–50%) extending in this corner region at a side of the sewing product 12, and the remaining part (for example 70%–50%) extending in this corner region at the other side of the sewing product 12, then the operator activates the switch 9 for example by the knee through the actuating member 8. The actuation of the switch at transferring the signal through the control conductor 7 for corresponding control of the control device 38 has the result that the transporting movement of the sewing product 12 and the needle actuation is interrupted for example at 30%–50% before the full end of the base arc 13. The operator then turns the sewing product 12 in this corner region, for example by 90°, and after actuating a starting key located for example on the keyboard 39, the transporting movement of the sewing product 12 and the needle actuation is continued until the full end of the base arc 13, or in other words, for the remaining 70%–50% at the other side of the corner region. The operator initially stores in the control device 38 the information at which location of the base arc 13 the interruption by actuation of the switch 9 must be performed for example at 30% of the base arc 13 or at another point.

It will be understood that each of the elements described above, or two or more together, may also find a useful application in other types of constructions differing from the types described above.

While the invention has been illustrated and described as embodied in a festooning machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A festooning machine, comprising at least one movable transport element for a forward transportation and for transverse transportation of a sewing product, said transport element being formed as a transport roller; two vertically movable needles arranged at a distance near said transport element with an adjustable distance therebetween; a needle drive for vertically moving said needles; an independent drive unit which supports said transport element and provides movements of said transport element; an adjusting member which said drive unit engages at least one of said needles so as to displace said one needle with respect to said other needle to provide an adjustment of said distance between said needles; an electronic control device for controlling said drive unit, said drive unit being electronically controllable in dependence on stored and storable data for each movement of said transport element and for said adjustment of said distance between said needles, said drive unit having a motor for each movement of said transport element and for said adjustment of said distance between the needles by displacing said one needle.

2. A festooning machine as defined in claim 1, wherein said control device has a keyboard for a user-activated free inputting and modification of sewing parameters and for freely programming at least one memory of said control device and calling in stored data or programs.

3. A festooning machine as defined in claim 2, wherein said keyboard is formed for free introduction and modification of the sewing parameter selected from the group consisting of a seam density, arc height, arc length, seam width, curve design, and arc for corners, a starting point of corners and an end point of corners.

4. A festooning machine as defined in claim 1, wherein said control device is provided with a receptacle for a data carrier.

5. A festooning machine as defined in claim 1, wherein said control device has at least one data processing unit.

6. A festooning machine as defined in claim 1, wherein said drive unit is vertically liftable and lowerable for introducing the sewing product; and further comprising means for vertically lifting and lowering said drive unit.

7. A festooning machine as defined in claim 1, wherein said motor is formed as an alternating current motor.

8. A festooning machine as defined in claim 1, wherein said motor is formed as a direct current motor.

9. A festooning machine as defined in claim 1, wherein said motor is a pneumatic motor.

10. A festooning machine as defined in claim 1, wherein said motor is a hydraulic motor.

11. A festooning machine as defined in claim 1, wherein said motor is a stepper motor.

12. A festooning machine as defined in claim 1; and further comprising at least one data processing device operative for controlling said motor.

13. A festooning machine as defined in claim 1, wherein said drive unit has a carriage which is translatorily displaceable in said drive unit for transverse movement of said transport element, and a holder which supports said transport element and is rotatably and axially non-displaceably supported in said carriage.

14. A festooning machine as defined in claim 13, wherein said holder is formed as a shaft which supports said transport roller.

15. A festooning machine as defined in claim 14, wherein said drive unit has a first motor for rotating said transport element; and further comprising a transmission through which said motor acts on said shaft of said transport element for rotating the latter.

16. A festooning machine as defined in claim 15, wherein said first motor is mounted on said drive unit and transmits a rotary movement to said shaft which together with said carriage is translatorily displaceable; and further comprising an axial displacement connection engaging in a relatively displaceable hollow wedge shaft for translatory movement of said holder together with said carriage.

17. A festooning machine as defined in claim 16, wherein said displacement connection is formed as a wedge shaft.

18. A festooning machine as defined in claim 15, wherein said first motor and said transmission are held on said carriage and are translatorily displaceable together with said carriage.

19. A festooning machine as defined in claim 1, wherein said drive unit has a first motor for rotating said transport element, and a second motor which is fixed on said drive unit and provided with a drive device for the transverse movement of said transport element.

20. A festooning machine as defined in claim 19, wherein said drive unit has a third motor which is fixed on said drive unit and provided with another drive device for adjusting said one needle relative to the other needle.

21. A festooning machine as defined in claim 1, wherein said adjusting member for said one needle includes a slider which is translatorily displaceable and non-rotatable on said drive unit.

22. A festooning machine as defined in claim 19, wherein said drive unit has a carriage for the transverse movement of said transport element and an adjusting member for displacing said one needle and further comprising a driver fixed on one of said carriage and said slider, said driver being driven by said second motor and formed as a toothed belt engaging said driver.

23. A festooning machine as defined in claim 20; and further comprising a driver fixed on one of said carriage and said slider, said further driver being driven by said third motor and formed as a toothed belt engaging said driver.

24. A festooning machine as defined in claim 19, wherein said drive unit has a carriage for the transverse movement of said transport element and an adjusting member for displacing said one needle and further comprising a driver arranged on one of said carriage and said slider, said drive device being driven by said second motor and formed as a pinion which engages said driver.

25. A festooning machine as defined in claim 19, wherein said drive unit has a carriage for the transverse movement of said transport element and an adjusting member for displacing said one needle and further comprising a driver arranged on one of said carriage and said slider, said drive device being driven by said second motor and formed as a spindle which engages said driver.

26. A festooning machine as defined in claim 20; and further comprising a driver fixed on one of said carriage and said slider, said further drive device being driven by said third motor and formed as a pinion engaging said driver.

27. A festooning machine as defined in claim 20; and further comprising a driver fixed on one of said carriage and said slider, said further drive device being driven by said third motor and formed as a spindle engaging said driver.

28. A festooning machine as defined in claim 25, wherein said driver is formed as an element selected from the group consisting of a toothed rod, a nut and a threaded sleeve.

29. A festooning machine as defined in claim 26, wherein said driver is formed as an element selected from the group consisting of a toothed rod, a nut and a threaded sleeve.

30. A festooning machine as defined in claim 1, wherein said one needle has a needle receptacle, the other of said needles also has a needle receptacle which is translatorily displaceable on said needle receptacle of said one needle; and further comprising a needle drive which translatorily displaces said needle receptacle of said said other needle on said needle receptacle of said one needle.

31. A festooning machine as defined in claim 30, wherein said needle receptacle of said other needle has a guide opening, said needle receptacle of said one needle having a guide pin which is engageable in said guide opening and displaceably held in it.

32. A festooning machine as defined in claim 31, wherein said guide pin has an end abutment against which said needle receptacle of said other needle abuts.

33. A festooning machine as defined in claim 30; and further comprising a spring which prestresses said needle receptacle of said one needle relative to said needle receptacle of said other needle.

34. A festooning machine as defined in claim 33, wherein said spring is formed as a helical spring arranged between said needle receptacles.

35. A festooning machine as defined in claim 31, wherein said guide pin is mounted on said needle receptacle of said one needle and is displaceable in said guide opening of said needle receptacle of said other needle.

36. A festooning machine as defined in claim 30, wherein said adjusting member is formed as a slider which vertically displaceably engages said needle receptacle of said one needle.

37. A festooning machine as defined in claim 36; and further comprising a vertical displacement connection between said adjusting member and said needle receptacle of said one needle.

38. A festooning machine as defined in claim 37, wherein said vertical displacement connection is formed as a dovetail shaped guide with vertical guiding surfaces.

39. A festooning machine as defined in claim 1; and further comprising a thread laying element associated with said needles and driveable so that an end of said thread laying element runs over a curve; a crank drive acting on said laying element; and a superimposed swinging drive acting on said thread laying element as well and driven and controlled from said crank drive.

40. A festooning machine as defined in claim 39, wherein said crank drive has a rotatably driven cam disc with an outer control surface and a displacement member articulated eccentrically to said cam disc.

41. A festooning machine as defined in claim 40, wherein said swinging drive has a turnably supported swinging lever which has a cam abutting against said control surface of said cam drive.

42. A festooning machine as defined in claim 41, wherein said cam of said swinging lever is formed as a rotatable roller.

43. A festooning machine as defined in claim 39; and further comprising a connecting lever which articulately connects said cam drive and said swinging drive and on which said thread laying element is mounted.

44. A festooning machine as defined in claim 43, wherein said crank drive has a rotatably driven cam disc with an outer control surface and a displacement member articulated eccentrically to said cam disc, said swinging drive has a turnably supported swinging lever which has a cam abutting against said control surface of said cam drive, said connecting lever having one end articulately connected with said displacement member and another end articulately connected with said swinging lever.

45. A festooning machine as defined in claim 39, wherein said crank drive and said swinging drive are arranged within a common plane, said thread laying element being mounted substantially perpendicularly to said plane.

46. A festooning machine as defined in claim 44, wherein said cam disc, said displacement member, said swinging lever and said connecting lever are arranged substantially in a common plane, said thread laying element being mounted substantially perpendicularly to said plane on said connecting lever.

47. A festooning machine as defined in claim 39, wherein said crank drive has a rotatably driven toothed gear, a displacement member eccentrically articulated with said toothed gear, a turnably supported supporting arm articulately coupled with said displacement member, and a holder arranged on said supporting arm turnably about a supporting arm axis and non-displaceably, said thread laying element being mounted on said holder.

48. A festooning machine as defined in claim 47; and further comprising a cam control element which swingingly drives said holder about an axis of said supporting arm.

49. A festooning machine as defined in claim 48, wherein said crank drive has a toothed gear, said cam control element having an intermediate toothed gear, and an additional toothed gear which is driven through said intermediate toothed gear from said toothed of said crank drive and provided with a circumferentially extending cam track, said holder being provided with a cam abutting against said cam track.

50. A festooning machine as defined in claim 49, wherein said cam of said holder is formed as a roller.

51. A festooning machine as defined in claim 49, wherein said cam track is formed as a part of a cam disc.

52. A festooning machine as defined in claim 49, wherein said toothed gear and said intermediate toothed gear have axes which extend substantially parallel to one another and transverse to said displacement member, said supporting arm and said holder.

53. A festooning machine as defined in claim 47, wherein said supporting arm has an end which is opposite to a connection with said displacement member and is turnably supported with said end.

54. A festooning machine as defined in claim 53; and further comprising a fork which turnably supports said end of said supporting arm.

55. A festooning machine as defined in claim 1; and further comprising an electronic control device which controls said drive unit and a switch which is connected with said control device and is actuatable by a consumer so that by actuating said switch during producing an ornamental seam extending over the corner, said control device is controlled so that a transporting movement of the sewing product and a needle actuation is interrupted before a full end of a festoon to be executed, and after a manual turning of the sewing product an actuation of a starting key the transporting movement of the sewing product and the needle actuation is resumed until a full end of the festoon.

56. A festooning machine as defined in claim 55, wherein said control device is formed so as to store an end point of a last curve to be formed in a corner region on one side of the sewing product, so that during the actuation of said switch an interruption of formation of said curve is performed and then after the turning of the sewing product and actuation of the starting key, the formation of said curve is continued at another side in the corner region.

57. A festooning machine, comprising at least one movable transport element for a forward transportation and for transverse transportation of a sewing product; two vertically movable needles arranged at a distance near said transport element with an adjustable distance therebetween; a needle drive for vertically moving said needles; an independent drive unit which supports said transport element and provides movements of said transport element; an adjusting member through by means of which said drive unit engages at least one of said needles so as to displace said one needle in respect of said other needle to provide an adjustment of said distance between said needles.

* * * * *

UNITED STATES PATENT AND TRADEMARK OFFICE

CERTIFICATE OF CORRECTION

PATENT NO. : 5,555,831

DATED : September 17, 1996

INVENTOR(S) : Wolfgang Teetz, et. al.

It is certified that error appears in the above-indentified patent and that said Letters Patent is hereby corrected as shown below:

Title page, item [75], inventor: should read--Wolfgang Teetz.--.

Signed and Sealed this

Twenty-sixth Day of November 1996

*Attest:*

Bruce Lehman

BRUCE LEHMAN

*Attesting Officer*

*Commissioner of Patents and Trademarks*